United States Patent [19]

Kayfetz et al.

[11] 4,134,718

[45] Jan. 16, 1979

[54] OIL-BURNING ILLUMINATING DEVICE

[75] Inventors: Paul D. Kayfetz, Bolinas; Joseph McHugh; James Dugan, both of Mill Valley, all of Calif.

[73] Assignee: CMA, Inc., Bridgeport, Conn.

[21] Appl. No.: 749,232

[22] Filed: Dec. 10, 1976

[51] Int. Cl.[2] ..... F23Q 2/32

[52] U.S. Cl. ..... 431/125; 431/311; 431/320; 431/323

[58] Field of Search ..... 431/125, 320, 321, 322, 431/323, 310, 311, 298

[56] References Cited

U.S. PATENT DOCUMENTS

| | | | |
|---|---|---|---|
| 545,313 | 8/1895 | Robertson | 431/320 |
| 3,315,497 | 4/1967 | MacDonald | 431/125 X |
| 3,385,084 | 5/1968 | MacDonald | 431/125 X |

*Primary Examiner*—Edward G. Favors

*Attorney, Agent, or Firm*—Thomas M. Freiburger

[57] ABSTRACT

A device capable of burning household vegetable oil and producing a candle-like flame is disclosed. It includes a heat-resistant upright glass tube within which a fibrous wick is positioned, extending a short distance out the top. For supporting the tube and wick in a generally flat-bottomed container, such as a small drinking glass, a foot or stand having horizontally-extending projections and an upright sleeve may be connected to the bottom of the tube by insertion of the tube end in the sleeve. When the assembled tube, wick and foot are placed in a container and vegetable oil is added, at least to the level of the bottom of the wick, the extending portion of the wick may be ignited to produce a candle-like flame. The container is preferably transparent so that light is radiated in all directions, and a special container may be provided for seating atop a light-transmitting rod, so that light from the flame illuminates the rod.

3 Claims, 3 Drawing Figures

OIL-BURNING ILLUMINATING DEVICE

BACKGROUND OF THE INVENTION

The invention relates to illuminating lamps, and more particularly to a wick-type oil-burning device.

Various types of vegetable oil burning lamps, wherein the oil is burned on a wick, have previously been suggested. For example, see U.S. Pat. No. 3,183,688, directed to a floating dish-shaped device; supporting an upright wick in a bottom recess. In this type device, vegetable oil was added to the dish in an area directly surrounding the wick. The device was to be floated on water or other liquid, with the top of the wick ignited to produce a candle-like flame.

Other oil-burning devices have utilized a wick and vegetable oil in various arrangements. None, however, has provided a wick-type oil-burning device having structural features which result in the versatility and other important advantages of the present invention described below.

SUMMARY OF THE INVENTION

The present invention is a wick-type vegetable oil burning lamp which may be positioned in virtually any container, preferably a transparent container, for emitting a soft candle-like light in all directions. The container used may be very small, and a small amount of vegetable oil placed in the container is drawn up a wick closely retained in a heat-resistant glass tube. The oil may be ignited at the short length of the wick which extends out the top of the tube. The inside diameter of the tube and the size of the wick are chosen such that capillary through the tube-encased wick is maximized, and oil may be pulled up the wick for a distance of one and one-half inch or more.

A foot, or bottom stand, is provided for the glass tube to hold it upright in a container without blocking the entrance of oil to the bottom of the tube and the wick therein. The foot includes projections extending outwardly in a horizontal plane and their length is chosen such that the smallest cylindrical container within which the device can be placed is just large enough for adequate heat dissipation from the flame.

A special small container may be provided for the burning device, so that the wick assembly and container may be placed on the top of an acrylic or other substantially transparent light-conducting rod to produce a "light-pipe" effect. Light is radiated in all directions from the flame, including downwardly, and passes through the container bottom and into the acrylic rod, which emits a glowing light and may transmit light down into a base or other object below. The foot projections of the device are preferably narrow and translucent, so that they block almost no light from passage into the rod.

Once ignited, the lamp of the invention will continue to burn oil for many hours. However, once the flame is extinguished and the wick cools, the wick should be replaced or raised in the tube with tweezers and snipped off to produce a fresh wick end. This is because the wick acts as a filter, absorbing many impurities in the vegetable oil and leaving a residue at the wick top which creates difficulty in relighting an extinguished and cooled wick.

Wick replacement is easily accomplished. The glass tube may be lifted out of the container by its top, without getting the fingers into any oil which may be remaining in the container.

It is therefore among the objects of the invention to provide a wick-type vegetable oil lamp which is relatively simple in construction, readily assembled and versatile in application, and which is also capable of producing an attractive flame which radiates in all directions and may be used to illuminate a light pipe below the container. These and other objects, advantages and features will become apparent from the following description of a preferred embodiment, taken in conjunction with the accompanying drawings.

DESCRIPTION OF THE PREFERRED EMBODIMENT

Figure 1:
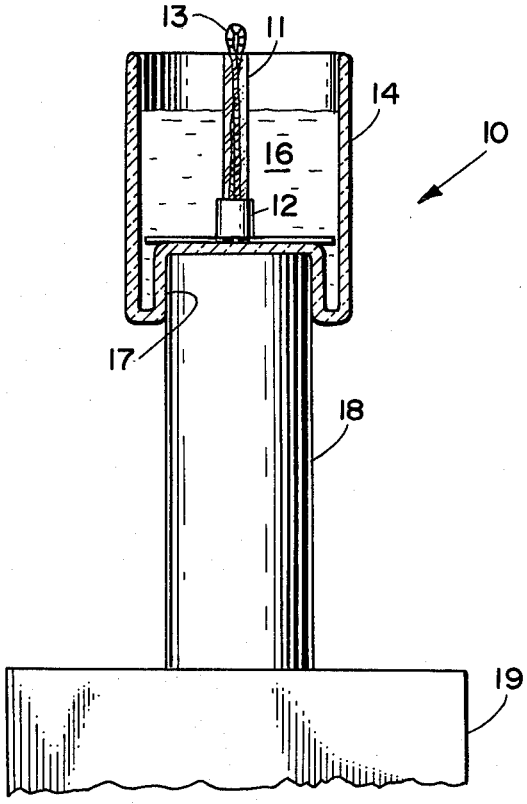
FIG. 1 is a partially sectioned elevational view of the illuminating device of the invention, including a container seated on a light pipe stand.

In the drawings, FIG. 1 shows an oil-burning lamp assembly generally indicated by the reference number 10. The assembly includes a wick-holding tube 11 preferably of a transparent, heat-resistant glass such as borosilicate glass (e.g., that sold under the trademark "Pyrex"), a "foot" or tube stand 12 assembled onto the bottom of the tube 11 for maintaining it in an upright position, and a wick 13 which is preferably doubled over as shown, extending to the bottom end of the tube 11. The wick 13 is of braided or twisted natural fiber, and should extend about one-fourth inch above the top of the tube 11.

The lamp assembly 10 may also include a special container 14 for retaining the tube, foot and wick and for receiving a quantity of combustible vegetable oil 16, or any container having a relatively flat portion in its bottom surface may be used. The advantage of the specific cylindrical container 14, which is preferably glass, is twofold. Its inside mouth diameter (about 1.3 inches) is just large enough to provide adequate heat dissipation from a flame (not shown) at the extending portion of the wick, without overheating the container. Thus, its size is minimized. The foot 12 is sized to fit into the container 14 with a small clearance, so that the wick-holding tube 11 is generally centered in the container.

The other important feature of the container 14, along with its transparency, is a generally cylindrical recess 17 extending upward in its bottom. In order to support the container 14 and the entire assembly 10, and to provide for the emission of light from the flame in all directions, a light-conducting translucent or transparent rod 18 may extend into the recess 17 and act as a stand. This preferably acrylic rod stand 18 receives light radiated downwardly by the flame, through the bottom of the container 14, and transmits the light in a "light pipe" effect. The acrylic material emits light outwardly in a sort of glowing fashion which is very attractive. There may also be provided a base 19 at the bottom of the rod stand 18, also of translucent or substantially transparent material. This base 19 accepts a portion of the light conducted by the rod 18 and also emits an attractive glow. Of course, the base 19, or both the base 19 and the rod 18, may be of an opaque material if desired. Also, the special container 14 may be used without the rod 18 and base 19, if desired, on any surface.

Figure 2:
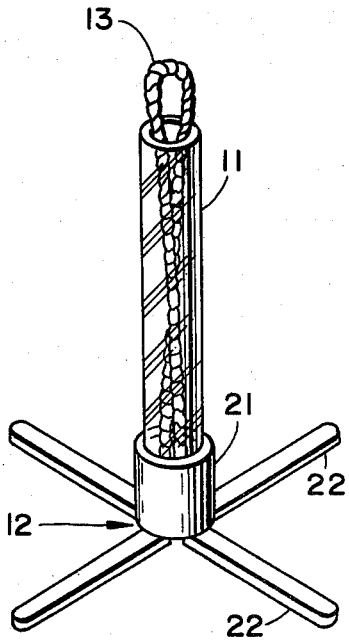
FIG. 2 is a perspective view of the wick-holding tube with its foot attached.
Figure 3:
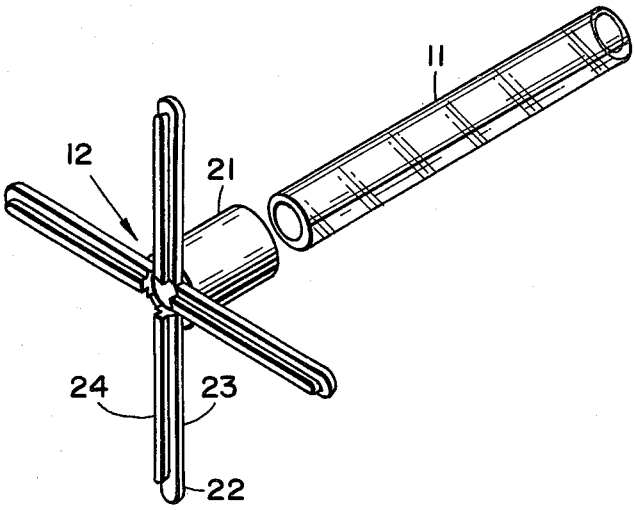
FIG. 3 is an exploded perspective view showing the tube and foot separated.

FIGS. 2 and 3 show the wick-retaining tube 11 and the foot or tube stand 12 in greater detail. The tube 11 may be about one and one-fourth inch tall with an inside diameter of about one-eighth inch. This diameter has been found optimum with respect to capillarity when using a common 12-ply medium braided wick of the type used for candle making. The closely surrounding glass tube 11 aids and adds to the capillarity of the wick, enables the use of an ordinary, unstiffened, wick, and also grips the wick sufficiently to allow it to stand freely at any height in the tube, even before it is wetted with oil. Any looser fit between the wick and the tube would cause the loss of this added capillarity effect, while a tighter fit would make insertion of the wick difficult and, if significantly tighter, would reduce the absorption capability of the wick and thus its capillarity. A wick and tube provided in accordance with the invention will draw vegetable oil to a height of one and one-half inch or more, so that the container used (e.g., the container 14) can be relatively tall and hold a relatively large quantity of oil without being of a large diameter.

The removable tube stand 12 is preferably of a resilient plastic material, including a sleeve 21 and a plurality of horizontally extending projections 22. The inside of the sleeve 21 is sized to fit snugly over the end of the tube 11, and may be tapered, narrowing toward its bottom, so that the tube is firmly wedged therein. The projections 22 may be integrally molded with the sleeve 21 or may be fused to the bottom of the sleeve. To center the foot 12 and tube 11 within the container 14, the projections are preferably of equal length (to just fit inside the container 14 as discussed above) and extend radially from the sleeve 21 as shown.

The preferred structure of the projections 22 is best seen in FIG. 3. They are narrow and should be of a translucent plastic material so that their obstruction of light passing downward to the rod 18 is minimized. Each projection is preferably T-shaped in cross section, with an upper flange 23 and a short downwardly-extending stem or web 24. This construction establishes strength in both the vertical and horizontal planes of the projections 22, enabling them to be thin and light and minimizing material required. Although four projections 22 are shown in the drawings, three equally spaced projections may alternatively be used.

It should be understood that other foot configurations can be employed to hold the wick-retaining tube 11 upright in a container. In fact, the tube 11 may be retained by a container bottom itself. A container of the oil lamp assembly 10 may include a sleeve formed in its bottom, for example (not shown), with openings in the container sleeve or in the side of the tube 11 near its bottom for communication of oil in the container with the wick.

For use of the oil-burning lamp of the invention, the wick 13 is inserted into the glass tube 11 as shown in FIG. 1, either before or after the assembly of the tube into the foot 12. This assembly is then placed in a preferably transparent container, which may be the container 14 illustrated in FIG. 1. Vegetable oil is added at least to a level slightly higher than the bottom of the wick 13. After a few minutes, oil soaks into and is drawn up the wick to its top. The wick may then be ignited to produce a pleasant candle-like flame which will continue to burn as long as the oil supply lasts. One fluid ounce of a typical household vegetable salad oil, for example, will burn for eight hours or longer.

As discussed previously, when the flame is extinguished and the wick cools, filtered hydrocarbon impurities at and near the top of the wick make relighting very difficult. Therefore the wick should be pulled up and snipped off, with one-fourth inch again exposed above the tube 11. This can be repeated until the bottom of the wick is so high in the tube that potential burning time is undesirably short. Of course the wick can be replaced after each use if desired.

The lamp assembly 10 of the invention avoids the need for a large container capable of floating a wick and oil holding device on water. The use of the tube 11 surrounding the wick 13 provides for a high capillary drawing capability and enables the use of a small, relatively tall oil reservoir such as the container 14. In addition, light is radiated by the lamp assembly 10 in all directions, and a decorative rod stand may be used to receive and emit a portion of the light. The assembly is compact, simple and inexpensive to manufacture.

Figure 4:
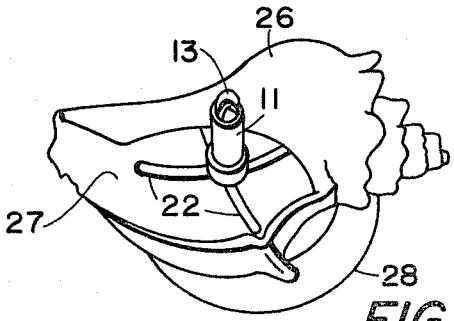

FIG. 4 shows another decorative way in which the wickstand device shown in FIGS. 2 and 3 can be utilized. As illustrated, the device can be placed in or lightly forced down into a seashell 26, with the flexible foot projections 22 readily conforming to the curved interior surface 27 of the shell. Combustible oil can be placed in the shell, retained by the interior surface 27, so that it soaks into the wick 13. Such a seashell is usually at least partially translucent, so that a flame burning from the top of the wick 13 causes much of the shell to glow. A base 28 of annular or other configuration may be glued to the bottom of the shell 26 for stability.

Another very decorative way to use the wickstand is to place it within a larger seashell (not shown), so that most or all of the wickstand device is hidden from view, but the heated air and gases from the flame are vented through the shell's opening. This produces a dramatic glowing of the entire shell when the oil burning device is ignited. Many other decorative uses of the wickstand assembly are also possible.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

We claim:

1. An oil-burning illuminating device for producing a candle-like flame, comprising:

a container having a closed bottom and an open top;

a tubular, heat-resistant wick holder, open at both ends;

a fibrous wick retained in the wick holder, extending outwardly from one end; and means associated with the other end of the wick holder and with the container bottom for retaining the wick holder upright in the container with said one end upward, said means comprising a flat portion of the container bottom and a foot connected to said other end of the wick holder, having horizontally-extending projections for seating flatly on said flat portion, said foot including an upwardly-extending sleeve sized to fit tightly over said other end of the wick holder for connecting the foot to the wick holder, said sleeve being open at its bottom to admit oil to the wick holder and the wick, whereby combustible oil may be placed in the container to a level at least above said other end of the wick holder and burned at the outwardly extending portion of the wick.

2. An oil-burning illuminating device for producing a candle-like flame, comprising:

a container having a closed bottom and an open top;

a tubular, heat-resistant wick holder, open at both ends;

a fibrous wick retained in the wick holder, extending outwardly from one end;

means associated with the other end of the wick holder and with the container bottom for retaining the wick holder upright in the container with said one end upward; and a stand of clear, light-conducting material;

the container being of transparent material and having an upwardly-extending recess in its bottom, shaped to receive the top of the stand, whereby combustible oil may be placed in the container to a level at least above said other end of the wick holder and burned at the outwardly extending portion of the wick and whereby light from the oil flame at the top of the wick passes through the container bottom and into the stand, and light from the flame is emitted in nearly all directions.

3. An oil-burning illuminating device for producing a candle-like flame, comprising:

a tubular, heat-resistant wick holder, open at both ends;

fibrous wick retained in the wick holder, extending outwardly from one end;

a foot removably retained to the other end of the wick holder, including a sleeve sized to fit tightly over said other end, said sleeve being open at its bottom to admit oil to the wick holder and the wick, and means connected to the sleeve for retaining the wick holder vertically on a flat surface with said one end upward;

whereby the wick holder and attached foot may be positioned on the flat bottom of a container and combustible oil may be placed in the container to a level at least above said other end of the wick holder and burned at the outwardly-extending portion of the wick.

* * * * *